US010255896B2

(12) United States Patent
Hsueh et al.

(10) Patent No.: US 10,255,896 B2
(45) Date of Patent: Apr. 9, 2019

(54) SOUND-ABSORBING MASK

(71) Applicant: Huan-Cheng Chang, Taoyuan (TW)

(72) Inventors: Chang-Wei Hsueh, Taoyuan (TW); Yiin-Kuen Fuh, Kaohsiung (TW)

(73) Assignee: Huan-Cheng Chang, Taoyuan (TW)

( * ) Notice: Subject to any disclaimer, the term of this patent is extended or adjusted under 35 U.S.C. 154(b) by 199 days.

(21) Appl. No.: 15/495,960

(22) Filed: Apr. 24, 2017

(65) Prior Publication Data

US 2018/0018951 A1 Jan. 18, 2018

(30) Foreign Application Priority Data

Jul. 12, 2016 (TW) ..... 105121961 A

(51) Int. Cl.

| | |
|---|---|
| ***A62B 18/02*** | (2006.01) |
| ***A41D 13/11*** | (2006.01) |
| ***H04R 1/08*** | (2006.01) |
| ***H04R 1/12*** | (2006.01) |
| ***G10K 11/16*** | (2006.01) |
| ***G10K 11/168*** | (2006.01) |
| ***G10K 11/162*** | (2006.01) |
| *A62B 18/00* | (2006.01) |

(52) U.S. Cl.

CPC ..... *G10K 11/161* (2013.01); *G10K 11/162* (2013.01); *G10K 11/168* (2013.01)

(58) Field of Classification Search

CPC ..... A62B 18/02; A62B 18/025; A41D 13/11; A41D 13/1138; H04R 1/12; H04R 1/08; H04R 1/083

See application file for complete search history.

(56) References Cited

U.S. PATENT DOCUMENTS 2,745,911 A * 5/1956 Webb ..... H04R 1/083 181/242
2,769,040 A * 10/1956 Di Mattia ..... H04M 1/03 381/354
3,027,896 A * 4/1962 Newton ..... A61M 16/18 128/203.29

(Continued)

FOREIGN PATENT DOCUMENTS

CN 2262732 Y 9/1997
CN 201515711 U 6/2010

(Continued)

*Primary Examiner* — Edgardo San Martin

(74) *Attorney, Agent, or Firm* — CKC & Partners Co., LLC

(57) ABSTRACT

A sound-absorbing mask is configured for covering a mouth. The sound-absorbing mask includes a covering body, a ventilation structure and a sound-absorbing portion. The covering body has a first chamber, a first and a second openings. The first chamber communicates with the first and the second openings. The first opening corresponds to the mouth. The ventilation structure is disposed at the second opening and has a second chamber, a third and a fourth openings. The second chamber communicates with the third and the fourth openings. The fourth opening is away from the first opening. The ventilation structure includes a plate disposed in the second chamber. The plate has a functioning surface facing the third opening. An edge of the plate and an inner wall of the ventilation structure have a gap in between. The sound-absorbing portion is disposed between the ventilation structure and the first opening.

10 Claims, 3 Drawing Sheets

(56) References Cited

U.S. PATENT DOCUMENTS

| | | | | | |
|---|---|---|---|---|---|
| 3,193,624 | A | * | 7/1965 | Wcbb | H04R 1/083<br>128/207.12 |
| 4,539,983 | A | * | 9/1985 | Angell | H04R 1/222<br>128/201.19 |
| 4,792,013 | A | * | 12/1988 | Boynton | G10K 11/16<br>181/21 |
| 4,883,052 | A | * | 11/1989 | Weiss | A41D 13/11<br>128/205.27 |
| 4,932,495 | A | * | 6/1990 | Chapman | G10K 11/16<br>181/18 |
| 6,997,178 | B1 | | 2/2006 | Reynaud | |

FOREIGN PATENT DOCUMENTS

| | | | |
|---|---|---|---|
| CN | 203692612 | U | 7/2014 |
| CN | 205161967 | U | 4/2016 |
| JP | 2009112740 | A | 5/2009 |

* cited by examiner

SOUND-ABSORBING MASK

RELATED APPLICATIONS

This application claims priority to Taiwanese Application Serial Number 105121961 filed Jul. 12, 2016, which is herein incorporated by reference.

BACKGROUND

Technical Field

The present disclosure relates to a sound-absorbing mask.

Description of Related Art

The main symptoms of Tourette's syndrome are involuntary abnormal actions such as fierce blinking, grimaces, head wagging, sudden scream, producing strange sounds, etc. Especially when a patient of Tourette's syndrome suddenly screams or produces strange sounds, the people around may be frightened. Therefore, patients of Tourette's syndrome are not readily accepted by the public.

Hence, in order to help patients of Tourette's syndrome integrate into the society, how to minimize the involuntary sound harassment to the others by the patients of Tourette's syndrome is undoubtedly an important issue in the medical profession.

SUMMARY

A technical aspect of the present disclosure is to provide a sound-absorbing mask, which can effectively reduce the influence to the others by the sound produced from the mouth of the patient of Tourette's syndrome.

According to an embodiment of the present disclosure, sound-absorbing mask is configured for covering a mouth. The sound-absorbing mask includes a covering body, a ventilation structure and a sound-absorbing portion. The covering body has a first chamber, a first opening and a second opening opposite to each other. The first chamber communicates with the first opening and the second opening. The first opening corresponds to the mouth. The ventilation structure is disposed at the second opening. The ventilation structure has a second chamber, a third opening and a fourth opening opposite to each other. The second chamber communicates with the third opening and the fourth opening. The third opening is at least partially located in the first chamber. The fourth opening is away from the first opening. The ventilation structure includes at least one plate disposed in the second chamber. The plate has a functioning surface facing to the third opening. An edge of the plate and an inner wall of the ventilation structure have a gap in between. The sound-absorbing portion is disposed between the ventilation structure and the first opening.

In one or more embodiments of the present disclosure, a quantity of the plate is plural. The plates align along between the third opening and the fourth opening.

In one or more embodiments of the present disclosure, the ventilation structure includes a duct. An end of the duct communicates with the fourth opening. Another end of the duct faces to the third opening. Each of the plates has a through hole. The duct penetrates through the through holes and connects with the plates.

In one or more embodiments of the present disclosure, the sound-absorbing mask further includes a cloth material. The cloth material at least partially covers the plate.

In one or more embodiments of the present disclosure, the sound-absorbing mask further includes a metal foil. The metal foil at least partially covers the plate.

In one or more embodiments of the present disclosure, the sound-absorbing portion includes a first subsidiary sound-absorbing portion and a second subsidiary sound-absorbing portion. The first subsidiary sound-absorbing portion has a sound-absorbing surface facing to the first opening. The second subsidiary sound-absorbing portion is located between the ventilation structure and the first subsidiary sound-absorbing portion.

In one or more embodiments of the present disclosure, a projecting area of the first subsidiary sound-absorbing portion facing to the ventilation structure, is larger than the third opening.

In one or more embodiments of the present disclosure the first subsidiary sound-absorbing portion and the second subsidiary sound-absorbing portion respectively include a sound-absorbing material.

In one or more embodiments of the present disclosure, the sound-absorbing mask further includes a metal sheet. The metal sheet is located between the second opening and the sound-absorbing portion. The metal sheet has a through hole. The ventilation structure at least partially penetrates through the through hole and connects with the metal sheet.

In one or more embodiments of the present disclosure, the coveting body is of a soft material.

When compared with the prior art, the above-mentioned embodiments of the present disclosure have at least the following advantages:

(1) By wearing the sound-absorbing mask, the sound produced from the mouth of the patient of Tourette's syndrome is restricted by the following three ways in order to reduce the influence to the others: (1) blocking the sound produced from the mouth of the patient of Tourette's syndrome by the covering body with the effect of sound insulation; (2) absorbing the sound in the first chamber by the sound-absorbing portion in order to reduce the sound volume of the sound; and (3) dissipating the energy of the sound entering into the second chamber by the vibration of the plate.

(2) Since the duct communicates with the fourth opening of the ventilation structure and faces to the third opening, air can enter into the second chamber of the ventilation structure from the outside, and consequently enter into the first chamber of the covering body. On the contrary, air can enter into the second chamber of the ventilation structure from the first chamber of the covering body, and consequently leave the sound-absorbing mask through the duct. In this way, the patient of Tourette's syndrome can carry out normal breathing after wearing the sound-absorbing mask.

BRIEF DESCRIPTION OF THE DRAWINGS

The disclosure can be more fully understood by reading the following detailed description of the embodiments, with reference made to the accompanying drawings as follows.

DETAILED DESCRIPTION

Figure 1:
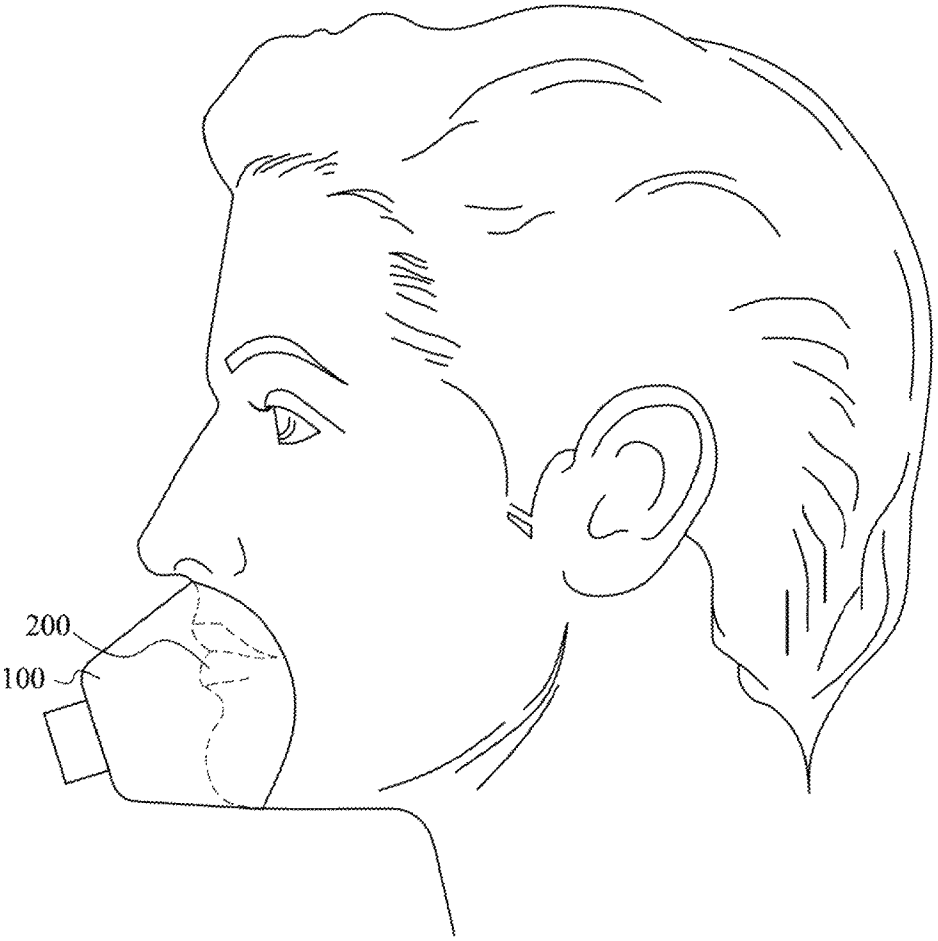
FIG. 1 is a schematic view of application of a sound-absorbing mask according to an embodiment of the present disclosure.

Drawings will be used below to disclose embodiments of the present disclosure. For the sake of clear illustration, many practical details will be explained together in the description below. However, it is appreciated that the practical details should not be used to limit the claimed scope. In other words, in some embodiments of the present disclosure, the practical details are not essential. Moreover, for the sake of drawing simplification, some customary structures and elements in the drawings will be schematically shown in a simplified way. Wherever possible, the same reference numbers are used in the drawings and the description to refer to the same or like parts.

Unless otherwise defined, all terms (including technical and scientific terms) used herein have the same meanings as commonly understood by one of ordinary skill in the art to which this disclosure belongs. It will be further understood that terms, such as those defined in commonly used dictionaries, should be interpreted as having a meaning that is consistent with their meaning in the context of the relevant art and the present disclosure and will not be interpreted in an idealized or overly formal sense unless expressly so defined herein.

Reference is made to FIG. 1. FIG. 1 is a schematic view of application of a sound-absorbing mask 100 according to an embodiment of the present disclosure. As shown in FIG. 1, a sound-absorbing mask 100 is suitable to wear on a face of a user, in order to cover his mouth 200.

Figure 2:
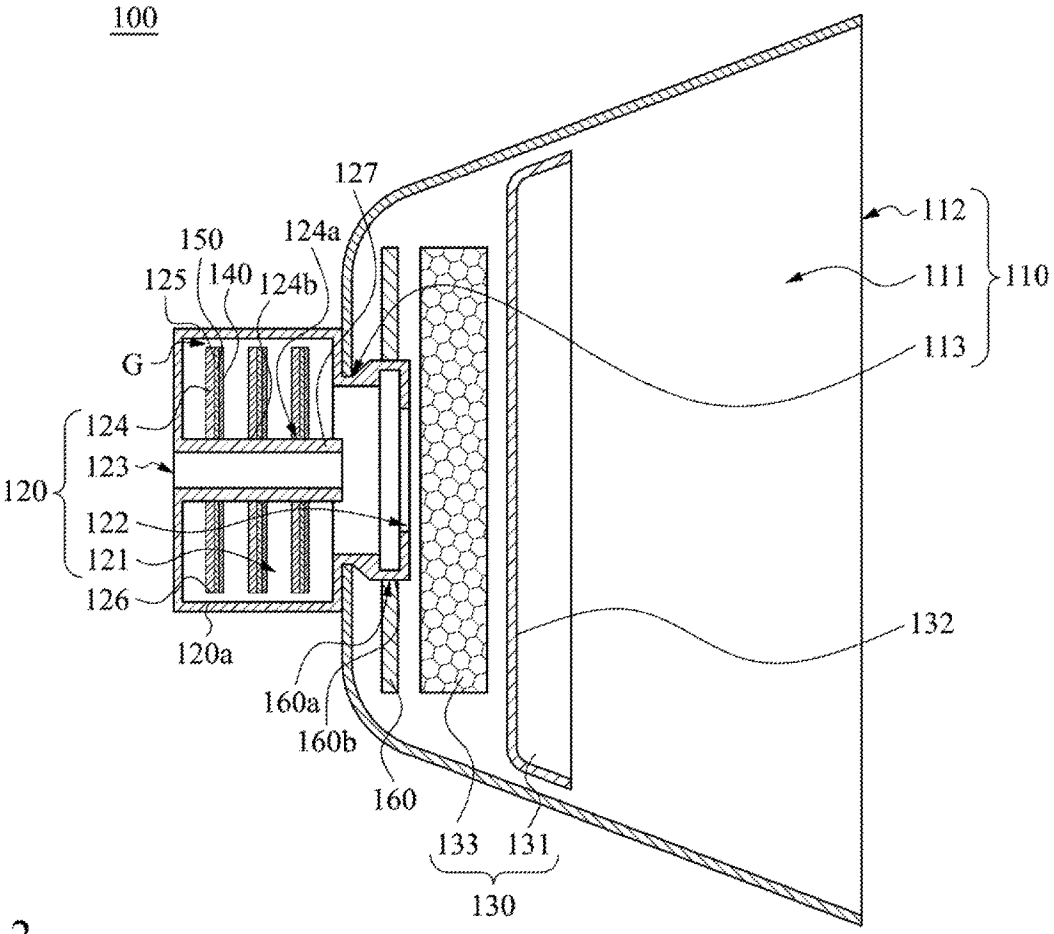
FIG. 2 is a cross-sectional view of the sound-absorbing mask of FIG. 1.
Figure 3:
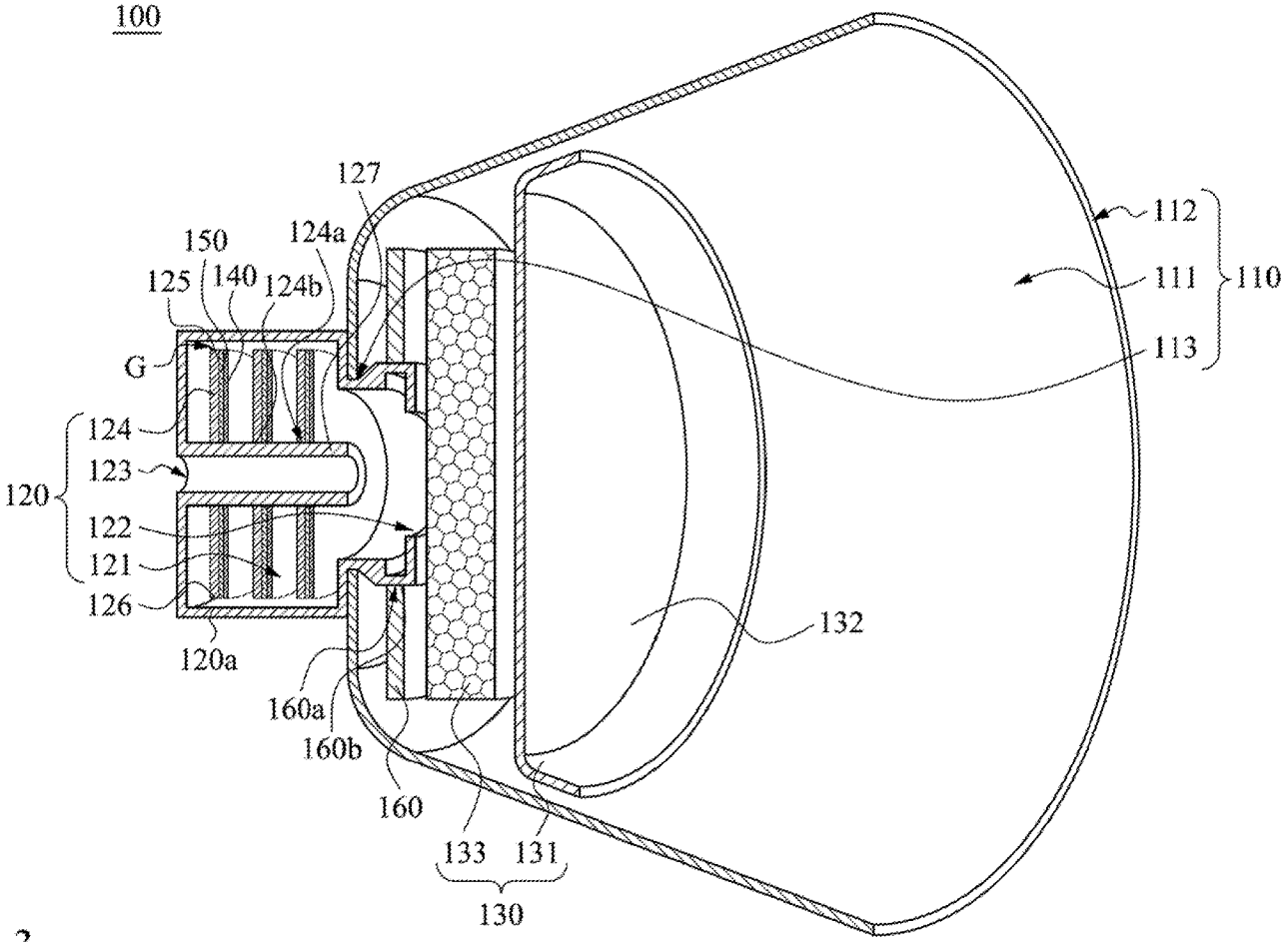
FIG. 3 is a three-dimensional cross-sectional view of the sound-absorbing mask of FIG. 1.

Reference is made to FIGS. 2-3. FIG. 2 is a cross-sectional view of the sound-absorbing mask 100 of FIG. 1. FIG. 3 is a three-dimensional cross-sectional view of the sound-absorbing mask 100 of FIG. 1. As shown in FIGS. 2-3, the sound-absorbing mask 100 includes a covering body 110, a ventilation structure 120 and a sound-absorbing portion 130. The covering body 110 has a first chamber 111, a first opening 112 and a second opening 113 opposite to each other. The first chamber 111 communicates with the first opening 112 and the second opening 113. The first opening 112 corresponds to the mouth 200 (please refer to FIG. 1). The ventilation structure 120 is disposed at the second opening 113 of the covering body 110. The ventilation structure 120 has a second chamber 121, a third opening 122 and a fourth opening 123 opposite to each other. The second chamber 121 communicates with the third opening 122 and the fourth opening 123. The third opening 122 is at least partially located in the first chamber 111 of the covering body 110. The fourth opening 123 is away from the first opening 112 of the covering body 110. In addition, the ventilation structure 120 includes at least one plate 124. The plate 124 is disposed in the second chamber 121. The plate 124 has a functioning surface 125. The functioning surface 125 faces to the third opening 122. An edge 126 of the plate 124 and an inner wall **120*a* of the ventilation structure 120 have a gap G in between. The inner wall 120*a* of the ventilation structure 120 surrounds the second chamber 121. The sound-absorbing portion 130 is disposed between the ventilation structure 120 and the first opening 112**.

To be more specific, when a patient of Tourette's syndrome wears the sound-absorbing mask 100, the first opening 112 of the covering body 110 corresponds to his mouth 200, and the covering body 110 covers the mouth 200, such that the mouth 200 is blocked by the sound-absorbing mask 100. When the mouth 200 of the patient of Tourette's syndrome produces a sound involuntarily and meaninglessly because of vocal tics, the sound produced will be trapped in the first chamber 111 of the covering body 110. In addition, the covering body 110 is of a soft material, which has an effect of sound insulation. As a result, the sound produced from the mouth 200 of the patient of Tourette's syndrome is uneasy to be transmitted from the first chamber 111 of the covering body 110 to the outside of the covering body 110. Therefore, by wearing the sound-absorbing mask 100, the influence to the others by the sound produced from the mouth 200 of the patient of Tourette's syndrome is effectively reduced.

In practical applications, the profile of the first opening 112 of the covering body 110 can be designed according to a face shape of the patient of Tourette's syndrome, so as to make the covering body 110 cover the mouth 200 of the patient of Tourette's syndrome more tightly, in order to increase the effect of sound insulation by the covering body 110.

On the other hand, the sound-absorbing mask 100 includes a sound-absorbing portion 130, and the sound-absorbing portion 130 is located in the first chamber 111 of the covering body 110. To be more specific, the sound-absorbing portion 130 is disposed between the ventilation structure 120 and the first opening 112 of the covering body 110. In this embodiment, the sound-absorbing portion 130 includes a sound-absorbing material. Thus, the sound produced by the mouth 200 of the patient of Tourette's syndrome will be absorbed by the sound-absorbing portion 130 in the first chamber 111 of the covering body 110. In this way, the sound volume of the sound in the first chamber 111 is effectively reduced. Therefore, by wearing the sound-absorbing mask 100, the influence to the others by the sound produced from the mouth 200 of the patient of Tourette's syndrome is effectively further reduced.

In addition, structurally speaking, the sound-absorbing portion 130 includes a first subsidiary sound-absorbing portion 131 and a second subsidiary sound-absorbing portion 133. The first subsidiary sound-absorbing portion 131 has a sound-absorbing surface 132. The sound-absorbing surface 132 faces to the first opening 112. The second subsidiary sound-absorbing portion 133 is located between the ventilation structure 120 and the first subsidiary sound-absorbing portion 131. Moreover, the first subsidiary sound-absorbing portion 131 and the second subsidiary sound-absorbing portion 133 respectively include a sound-absorbing material. In this way, the sound-absorbing surface 132 of the first subsidiary sound-absorbing portion 131 facing to the first opening 112 can effectively absorb the sound produced from the mouth 200 of the patient of Tourette's syndrome, such that the sound volume of the sound is effectively reduced. Moreover, the first subsidiary sound-absorbing portion 131 is exposed to other surfaces in the first chamber 111 and the second subsidiary sound-absorbing portion 133 is also exposed to other surfaces in the first chamber 111, which can help to absorb the sound produced from the mouth 200 of the patient of Tourette's syndrome, such that the sound volume of the sound is effectively reduced.

It is worth to note that a projecting area of the first subsidiary sound-absorbing portion 131 facing to the ventilation structure 120 is larger than the third opening 122 of the ventilation structure 120. In other words, the sound produced from the mouth 200 of the patient of Tourette's syndrome is at least blocked by the first subsidiary sound-absorbing portion 131, but not transmitted directly to the third opening 122 of the ventilation structure 120. In this way, the sound produced from the mouth 200 of the patient of Tourette's syndrome passes by the first subsidiary sound-absorbing portion 131 of the sound-absorbing portion 130 first before reaching the ventilation structure 120. This means, the sound volume of the sound reaching the ventilation structure 120 is already reduced at least due to the absorption by the first subsidiary sound-absorbing portion 131 of the sound-absorbing portion 130.

As shown in FIGS. 2-3, the ventilation structure 120 further includes a duct 127. An end of the duct 127 communicates with the fourth opening 123 of the ventilation structure 120. Another end of the duct 127 faces to the third opening 122 of the ventilation structure 120. Since the duct 127 communicates with the fourth opening 123 and faces to the third opening 122, air can enter into the second chamber 121 of the ventilation structure 120 from the outside, and consequently enter into the first chamber 111 of the covering body 110. On the contrary air can enter into the second chamber 121 of the ventilation structure 120 from the first chamber 111 of the covering body 110, and consequently leave the sound-absorbing mask 100 through the duct 127. In this way, the patient of Tourette's syndrome can carry out normal breathing after wearing the sound-absorbing mask 100.

As mentioned above, the plate 124 is disposed in the second chamber 121 of the ventilation structure 120. The functioning surface 125 of the plate 124 faces to the third opening 122. The edge 126 of the plate 124 and the inner wall 120*a* of the ventilation structure 120 have a gap G in between. In this way, after the sound produced from the mouth 200 of the patient of Tourette's syndrome reaches the ventilation structure 120, the sound will enter into the second chamber 121 through the third opening 122 of the ventilation structure 120, and consequently reach the functioning surface 125 of the plate 124. Since the edge 126 of the plate 124 near the gap G is a free end, the sound reaching the functioning surface 125 of the plate 124 will cause the plate 124 to vibrate with an end of the plate 124 away from the gap G as the base point. In other words, at least a part of the energy of the sound will be converted to, the energy of vibration of the plate 124. In this way, for the sound entering into the second chamber 121 through the third opening 122 of the ventilation structure 120, its energy will be dissipated on the vibration of the plate 124. As a result, the sound produced from the mouth 200 of the patient of Tourette's syndrome is further reduced.

In sum, by wearing the sound-absorbing mask 100, the sound produced from the mouth 200 of the patient of Tourette's syndrome is restricted by the following three ways in order to reduce the influence to the others: (1) blocking the sound produced from the mouth 200 of the patient of Tourette's syndrome by the covering body 110 with the effect of sound insulation; (2) absorbing the sound in the first chamber 111 by the sound-absorbing portion 130 in order to reduce the sound volume of the sound; and (3) dissipating the energy of the sound entering into the second chamber 121 by the vibration of the plate 124.

In order to achieve a better effect of sound reduction by the resonance of the plate 124 with the sound, a thickness of the plate 124 can be adjusted according to the actual conditions. For example, the thickness of the plate 124 can be between about 0.5 mm and about 1.0 mm. This means, for example, the thickness of the plate 124 can be 0.5 mm, 0.6 mm, 0.7 mm, 0.8 mm, 0.9 mm, 1.0 mm, etc. However, it is noted that the thicknesses of the plate 124 as cited herein are only illustrative and are not to limit the claimed scope. A person having ordinary skill in the art of the present disclosure may suitably choose the thickness of the plate 124 according to the actual conditions.

On the other hand, the sound-absorbing mask 100 further includes a cloth material 140. In practical applications, the cloth material 140 at least partially covers the plate 124, in order to generate extra effect of sound absorption. In this embodiment, the cloth material 140 can be of a non-woven material. However, this does not intend to limit the present disclosure.

In addition, the sound-absorbing mask 100 further includes metal foil 150. In practical applications, the metal foil 150 at least partially covers the plate 124, so as to adjust the overall resonance frequency of the plate 124 and the metal foil 150, such that effect of dissipation of sound energy by vibration is enhanced. In this embodiment, the metal foil 150 can be of copper foil. However, this does not intend to limit the present disclosure.

In practical applications, according to the actual conditions, a user can cover the plate 124 with the metal foil 150, and then cover the metal foil 150 with the cloth material 140, as shown in FIGS. 2-3. Or, in other embodiments, the user can also cover the plate 124 with the cloth material 140, and then cover the cloth material 140 with the metal foil 150.

In this embodiment, a quantity of the plate 124 is plural. The plates 124 align along between the third opening 122 and the fourth opening 123, so as to enhance the effect of dissipation of sound energy by vibration. For example, as shown in FIGS. 2-3, the quantity of the plates 124 is three.

To be more specific, each of the plates 124 has a through hole 124*a*. The duct 127 of the ventilation structure 120 penetrates through the through holes 124*a* of the plates 124, and connects with the plates 124. As shown in FIGS. 2-3, each of the inner walls 124*b* surrounding the corresponding through hole 124*a* and the duct 127 of the ventilation structure 120 connect. In other words, each of the plates 124 vibrate with the corresponding inner wall 124*b* connecting the duct 127 as the base point.

Furthermore, in this embodiment, the sound-absorbing mask 100 further includes a metal sheet 160. The metal sheet 160 is located between the second opening 113 of the covering body 110 and the sound-absorbing portion 130. The metal sheet 160 has a through hole 160*a*. The ventilation structure 120 at least partially penetrates through the through hole 160*a* of the metal sheet 160, and connects with the metal sheet 160. As shown in FIGS. 2-3, the inner wall 160*b* surrounding the through hole 160*a* and the ventilation structure 120 connect. Similarly, the metal sheet 160 vibrates with the inner wall 160*b* connecting the ventilation structure 120 as the base point, so as to dissipate the energy of the sound in the first chamber 111.

In conclusion, when compared with the prior art, the aforementioned embodiments of the present disclosure have at least the following advantages.

(1) By wearing the sound-absorbing mask, the sound produced from the mouth of the patient of Tourette's syndrome is restricted by the following three ways in order to reduce the influence to the others: (1) blocking the sound produced from the mouth of the patient of Tourette's syndrome by the covering body with the effect of sound insulation; (2) absorbing the sound in the first chamber by the sound-absorbing portion in order to reduce the sound volume of the sound; and (3) dissipating the energy of the sound entering into the second chamber by the vibration of the plate.

(2) Since the duct communicates with the fourth opening of the ventilation structure and faces to the third opening, air can enter into the second chamber of the ventilation structure from the outside, and consequently enter into the first chamber of the covering body. On the contrary, air can enter into the second chamber of the ventilation structure from the first chamber of the covering body, and consequently leave the sound-absorbing mask through the duct. In this way, the patient of Tourette's syndrome can carry out normal breathing after wearing the sound-absorbing mask.

Although the present disclosure has been described in considerable detail with reference to certain embodiments thereof, other embodiments are possible. Therefore, the spirit and scope of the appended claims should not be limited to the description of the embodiments contained herein.

It will be apparent to the person having ordinary skill in the art that various modifications and variations can be made to the structure of the present disclosure without departing from the scope or spirit of the present disclosure. In view of the foregoing, it is intended that the present disclosure cover modifications and variations of the present disclosure provided they fall within the scope of the following claims.

What is claimed is:

1. A sound-absorbing mask configured for covering a mouth, the sound-absorbing mask comprising:

a covering body having a first chamber, a first opening and a second opening opposite to each other, the first chamber communicating with the first opening and the second opening, the first opening corresponding to the mouth;

a ventilation structure disposed at the second opening, the ventilation structure having a second chamber, a third opening and a fourth opening opposite to each other, the second chamber communicating with the third opening and the fourth opening, the third opening being at least partially located in the first chamber, the fourth opening being away from the first opening, the ventilation structure comprising at least one plate disposed in the second chamber, the plate having a functioning surface facing to the third opening, an edge of the plate and an inner wall of the ventilation structure having a gap in between; and a sound-absorbing portion disposed between the ventilation structure and the first opening.

2. The sound-absorbing mask of claim 1, wherein a quantity of the plate is plural, the plates align along between the third opening and the fourth opening.

3. The sound-absorbing mask of claim 2, wherein the ventilation structure comprises a duct, an end of the duct communicates with the fourth opening, another end of the duct faces to the third opening, each of the plates has a through hole, the duct penetrates through the through holes and connects with the plates.

4. The sound-absorbing mask of claim 1, further comprising a cloth material at least partially covering the plate.

5. The sound-absorbing mask of claim 1, further comprising a metal foil at least partially covering the plate.

6. The sound-absorbing mask of claim 1, wherein the sound-absorbing portion comprises:

a first subsidiary sound-absorbing portion having a sound-absorbing surface facing to the first opening; and a second subsidiary sound-absorbing portion located between the ventilation structure and the first subsidiary sound-absorbing portion.

7. The sound-absorbing mask of claim 6, wherein a projecting area of the first subsidiary sound-absorbing portion facing to the ventilation structure is larger than the third opening.

8. The sound-absorbing mask of claim 6, wherein the first subsidiary sound-absorbing portion and the second subsidiary sound-absorbing portion respectively comprise a sound-absorbing material.

9. The sound-absorbing mask of claim 1, further comprising a metal sheet located between the second opening and the sound-absorbing portion, the metal sheet having a through hole, the ventilation structure at least partially penetrating through the through hole and connecting with the metal sheet.

10. The sound-absorbing mask of claim 6, wherein the covering body is of a soft material.

* * * * *